US006026600A

United States Patent [19]

Lela

[11] Patent Number: 6,026,600

[45] Date of Patent: Feb. 22, 2000

[54] SNOW TRAIL GROOMING ACCESSORY

[76] Inventor: Gary J. Lela, 204 N. Richmond Ave., Westmont, Ill. 60559

[21] Appl. No.: 09/023,429

[22] Filed: Feb. 13, 1998

[51] Int. Cl.[7] ..... E01H 4/00

[52] U.S. Cl. ..... 37/219; 280/762

[58] Field of Search ..... 37/219, 220, 221, 37/222; 172/188, 145, 197, 780, 787; 280/492, 762

[56] References Cited

U.S. PATENT DOCUMENTS

| | | | |
|---|---|---|---|
| 3,106,969 | 10/1963 | Carter | 172/197 |
| 3,478,827 | 11/1969 | Madson | 172/379 |
| 3,576,214 | 4/1971 | Ratcliffe | 172/393 |
| 3,666,020 | 5/1972 | Hess | 172/612 |
| 3,741,577 | 6/1973 | Rude | 280/18 |
| 3,795,069 | 3/1974 | Cheney | 37/48 |
| 3,872,931 | 3/1975 | Camp | 173/387 |
| 3,884,498 | 5/1975 | Cote, Jr. | 280/762 |
| 3,915,239 | 10/1975 | Hendrichon | 172/146 |
| 4,127,949 | 12/1978 | Sabrowsky et al. | 37/221 |
| 4,202,118 | 5/1980 | Held | 37/219 |
| 4,244,662 | 1/1981 | Olson | 404/118 |
| 4,341,027 | 7/1982 | Rohner | 37/219 X |
| 5,119,752 | 6/1992 | Doherty | 114/270 |

*Primary Examiner*—Robert E. Pezzuto
*Attorney, Agent, or Firm*—Heslin & Rothenberg, P.C.

[57] ABSTRACT

The invention comprises a snow trail grooming accessory and method for use with a snowmobile to groom a snow trail surface. The accessory includes at least one cutting member and a forcing member joined to the cutting member and attachable to the snowmobile. The cutting member is forced in a downward direction by the forcing member when the forcing member is attached to the snowmobile.

22 Claims, 6 Drawing Sheets

SNOW TRAIL GROOMING ACCESSORY

FIELD OF THE INVENTION

The present invention relates generally to a snow trail grooming accessory for use with a snowmobile. More specifically, the invention concerns a trail grooming accessory for use with an operating snowmobile to prevent the initial formation of snow moguls, snow mounds and the like, and also, to aid in leveling a snow trail affected by existing snow moguls, snow mounds and the like.

BACKGROUND OF THE INVENTION

Various snow trail grooming devices exist in the prior art. Many of the known prior art devices resemble towable sled devices hitched behind a vehicle for towing over a snow trail to groom the same. These devices are designed for use with personal motor craft (e.g., a snowmobile and the like) and industrial type towing vehicles. Of these, only the devices for use with a personal motor craft vehicle are intended for towing behind a snowmobile under operating conditions, i.e., at operating speeds while traveling over a snow trail. These devices can serve their intended purpose rather well, especially when one desires to tow a load of articles behind the vehicle while also performing snow grooming. However, when one does not desire to tow such a device behind their vehicle but still desires to conduct snow trail grooming while operating the vehicle, a more compact and economical trail grooming device is needed.

As appreciated by one of ordinary skill in the art, and moreover by the average snowmobile operator, most snowmobiles are driven by a centrally located track which comes into contact with a ground surface (e.g., usually snow), over which the snowmobile travels. During operation of the snowmobile, and particularly upon commencing forward travel, the snow engaging portion of the track moves from the front of the snowmobile to the back of the snowmobile. The track lifts some of the snow it contacts and displaces or sprays it backwards to a back track location where the track looses contact with the snow covered surface upon initial forward movement. As a result of the snow displacement or spray effect, a pile of snow is usually deposited just behind the position where the back end of the snowmobile was located.

If this pile is left alone, it merely represents a mound of snow in the snowmobile path or trail. If this pile is traveled over by other snowmobiles it is compacted and eventually forms a mogul or the like. In either case, this pile of snow creates a disturbance in the snowmobile trail. Such a disturbance is sometimes desirable to provide a more challenging snowmobile ride. However, even just one of these disturbances can make operating a snowmobile difficult given the unlevel or uneven snow surface on the snow trail. Furthermore, when considering a popular snow trial, it is evident that over a period of time and with many snowmobiles traveling over the same trail, the snow mound and/or snow mogul effect will be multiplied and the difficulty to the snowmobile operator could become quite significant.

To a somewhat lesser degree, but still significant and particularly so depending on snow moisture conditions, during operation of the snowmobile over a snow trail, a snow spray is continuously propelled outward and upward from the back of the snowmobile, but not usually at a constant rate. The amount of snow spray depends on the speed of the snowmobile and the snow moisture conditions. Thus, in the ordinary course of operating the snowmobile, simply changing speeds can, regardless of moisture conditions, vary the amount of snow sprayed whereby any positive differential amount will cause a snow mound, and in due course over time a mogul or the like.

One way to deal with the snow mounds, snow moguls and the like is to remove them well after they have formed, i.e., with equipment that is proposed by some prior art devices. Such an approach is commendable, however, it can ignore the bigger part of the problem, namely, the creation of snow mounds, snow moguls and the like in the first place. Furthermore, with some prior art devices, although they remove the snow mounds, moguls and the like, solving one problem, such action often creates another problem. Over a short period of time, employing merely a device or method that removes the trail disturbance well after its formation tends to form a snow trail rut where the prior art device has scraped over the snow trail and pushed the loose snow off or out of the sides of the device. As is obvious in geographic locations where there is not a steady supply of new snow or a substantial snow base, such a scrapping action significantly displacing the snow trail snow would destroy a snowmobile trail in a short period of time.

Accordingly, a more compact and economical trail grooming accessory, which can be directly attached to a snowmobile, is needed. Further, such a device will desirably include the features of enabling trail grooming while operating the snowmobile, in order to prevent the initial formation of snow mounds, moguls and the like, and with minimal disturbance to the natural snow covered condition of the snow trail.

SUMMARY OF THE INVENTION

According to my present invention I have provided a snow trail grooming accessory for use with a snowmobile to groom a snow trail surface. The accessory includes at least one cutting member and a forcing member joined to the cutting member and attachable to the snowmobile. The cutting member is forced in a downward direction by the forcing member when the forcing member is attached to the snowmobile.

Another feature of my invention relates to a method for grooming a snow trail having a level portion, a snow mound, a snow mogul or a hazardous snow trail disturbance. The method may comprise the steps of: moving at least one cutting member in a forward direction in combination with a snowmobile, wherein the snowmobile produces a snow displacement and the at least one cutting member being attached to the snowmobile; forcing the at least one cutting member in a downward direction; and, leveling at least a portion of the snow displacement when the at least one cutting member is moving.

Still other features of my invention concern the accessory preferably comprising a plurality of cutting members, where each cutting member is independently supported and/or forced.

According to other preferred features of my invention I have also provided advantageous shapes and configurations for making and positioning the snow trail grooming accessory components.

In accordance with the following, the present invention advantageously provides a means of slicing up snow mounds, snow moguls and the like, immediately upon formation, without the need of towing a separate grooming structure behind the snowmobile.

Further, the invention may advantageously pull or draw snow trail disturbances forward into crevices or valleys where the snow trail surface is of a lower height than the average snow trail surface of a snowmobile trail, thereby smoothing out bumpy snow surfaces while traversing a snowmobile trail.

Still further, the invention may advantageously at least partially deflect a portion of a snow spray or displacement of an operating snowmobile moving over a snowmobile trail.

Yet further, the invention may advantageously provide an attachable snow trail grooming accessory that enables the snowmobile to be conventionally operated in a forward or reverse direction of travel and loaded on to and off of a towing trailer without having to remove the snow trail grooming accessory from the snowmobile.

The prior art trail grooming devices do not offer the flexibility and inventive features of my trail grooming accessory for use with a snowmobile. As will be described in greater detail hereinafter, the features of the present invention differ from those previously proposed.

Other features and advantages of my invention will become more readily apparent upon reference to the following description when taken in conjunction with the accompanying drawings, which drawings illustrate several embodiments of my invention.

DETAILED DESCRIPTION OF THE PREFERRED EMBODIMENT

Figure 1:
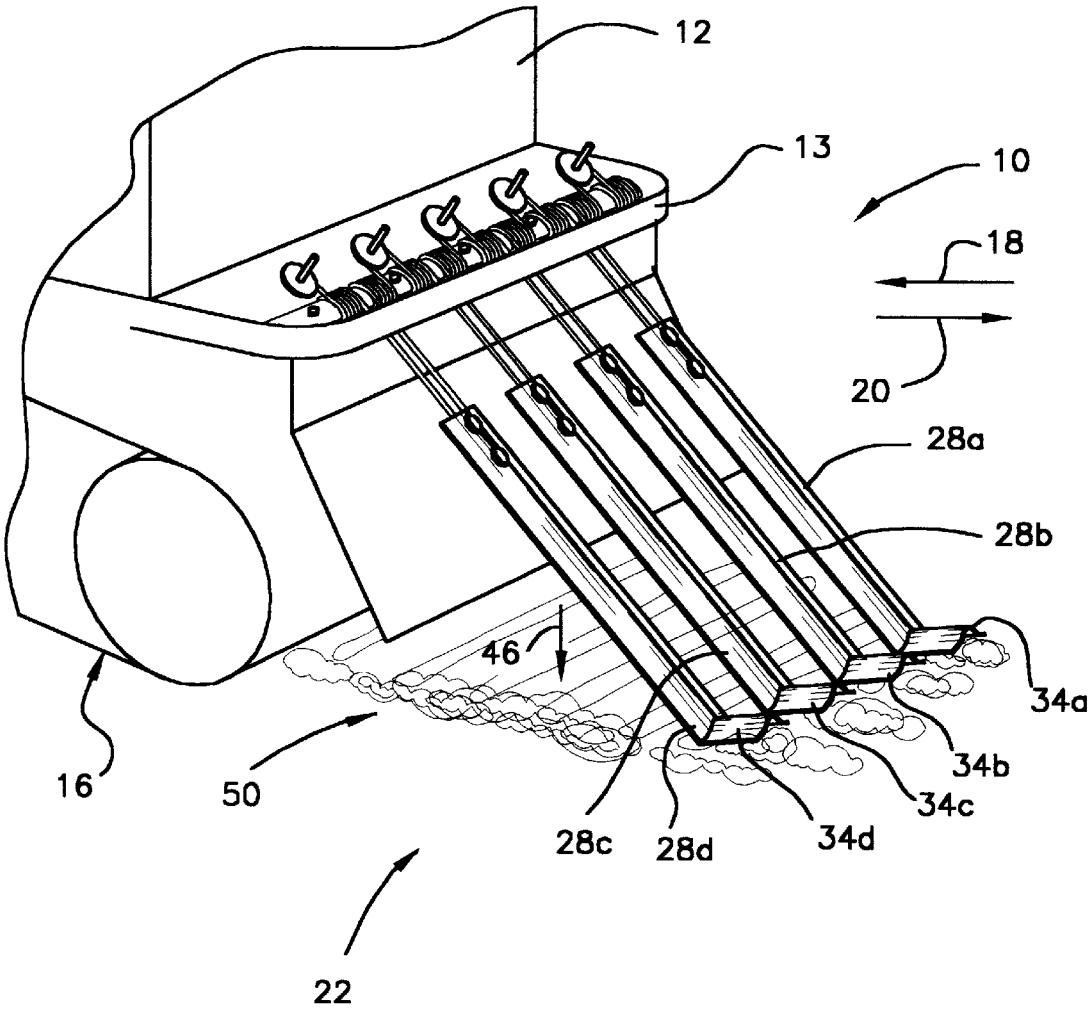
FIG. 1 is a perspective view of a trail grooming accessory attached to a snowmobile, in accordance with the features of this invention.
Figure 2:
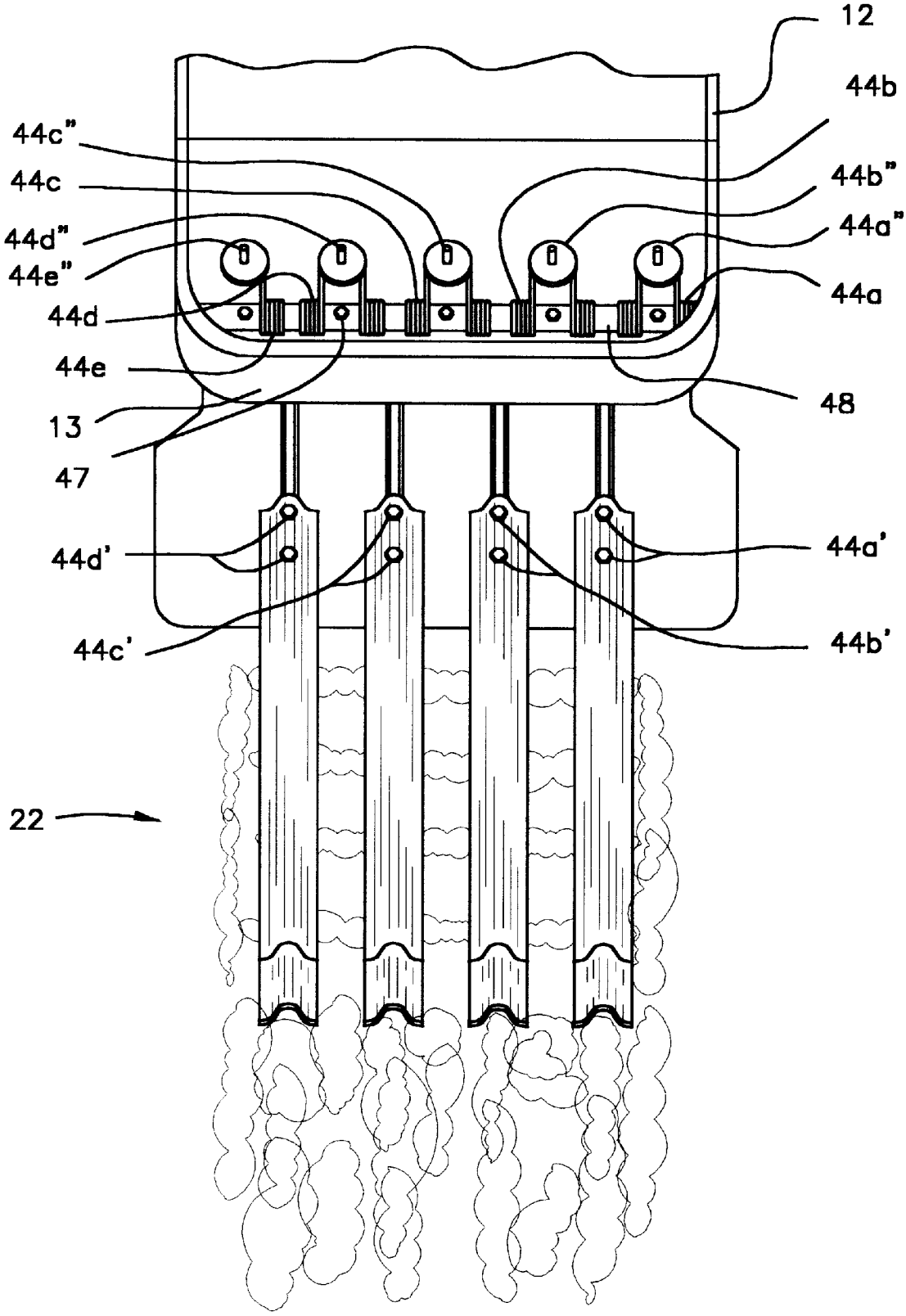
FIG. 2 is a back view of the trail grooming accessory of FIG. 1.

Referring generally to the drawings, and particularly FIGS. 1 and 2 for example, there is seen a snow trail grooming accessory 10 for use with a snowmobile 12 to groom a snow trail surface or snow trail 22, while operating the snowmobile as desired. The snowmobile generally includes a track or tracks 16, where the track has a bottom surface 14 for engaging the snow trail.

The accessory 10 comprises at least one cutting member, such as any one of cutting members 28*a–d*. Although the features of the invention can be achieved with only one cutting member, preferably four such cutting members are employed. However, the desired number of cutting members is generally dependent on a width of the snowmobile track 16, as it is the spin of the track and snow spray therefrom which causes the formation of a snow trail disturbance 26 (e.g., such as a snow displacement or spray, a snow mound, a snow mogul or a hazardous snow trail disturbance (not shown) such as a rock, tree limb or other relatively fixed ground structure). For example, for a Polaris™ 1994 year, model Trail Touring type snowmobile four cutting members are believed to be optimal.

When employing a plurality of similar cutting members, each member is preferably spaced from each adjacent member. In this way, the cutting members serve to deflect at least a portion of a snowmobile snow spray or displacement in a downward direction 46 while allowing a portion to pass through the space in between the cutting members. Further, this arrangement enables the snow trail grooming accessory to displace forward a portion of a snow mound, a snow mogul or a snow spray or displacement, without displacing forward all of the same and likely causing an undesirable snow trail rut over time.

Figure 4:
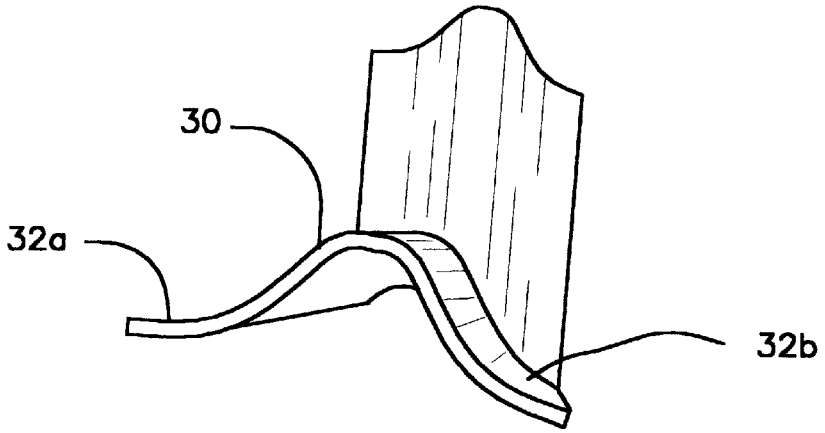
FIG. 4 is a top end view of a cutting member, where the member is removably detached from its forcing member.

The cutting member(s), and all components in fact, are preferably constructed of a rigid material, such as steel, aluminum, plastic hard rubber, etc. Particularly excellent results are believed to be obtained when all components of the invention are constructed of a rust resistant rigid metal material (e.g., galvanized steel) or have a rust resistant coating to enhance the durability and longevity of the components. The cutting member(s) may be shaped to be flat, curved, square, rounded, etc. However, excellent results are obtained when the cutting member has a wave shape formed by a longitudinal channel 30 located between flared side portions 32*a*, 32*b* (FIG. 4 for example). Further, with this preferred shape, the cutting member(s) are preferably positioned so that the flared side portions face a forward direction 18, as seen in FIG. 1 for example.

Figure 3:
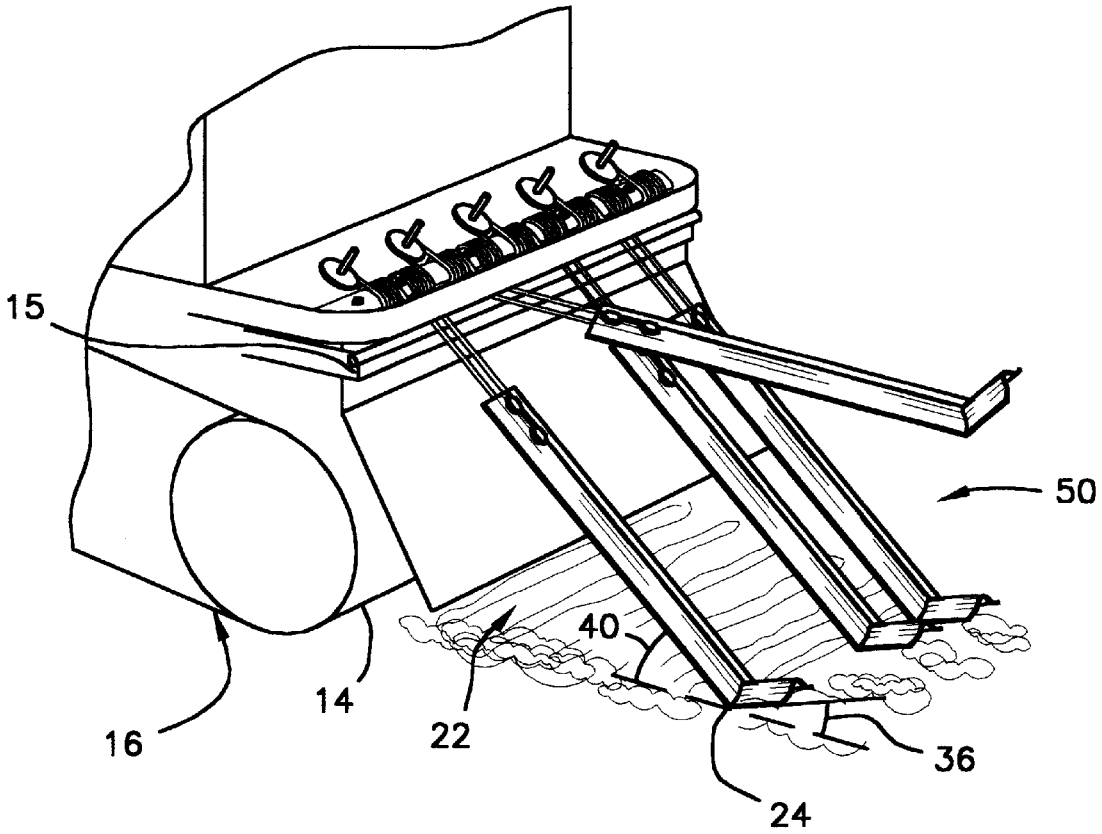
FIG. 3 is another perspective view of the trail grooming accessory of FIG. 1, here depicting one cutting member held up against a downward force which preferably independently forces the cutting members in a downward direction.

The cutting member(s) also preferably includes an angled end portion, such as end portions 34*a–d*. The angled end portion provides additional mass at the end of the member and assists the cutting member in breaking up a snow trail disturbance upon impacting the same. Also, the angled end portion enables the cutting member(s) (i.e, the whole accessory) to be moved in a reverse direction 20, without having to specially manipulate the accessory or detach the same from the snowmobile, when operating the snowmobile in a reverse direction or when loading the snowmobile on to or off of a towing trailer. Further, in this regard, the end portion 34 is preferably positioned at an angle 36 (FIG. 3, for example), in the range of 10 degree to 90 degrees relative to a level portion 24 of the snow trail surface.

The accessory 10 further comprises a forcing member, such as any one of members 44*a–e* (FIG. 2, for example). The forcing member is preferably joined to the cutting member by joining members 44′–*d*′. The forcing member is attachable to the snowmobile directly by attaching members 44*a*″–*e*″, but preferably by an indirect means as described hereinafter. The attaching member can serve to not only attach the forcing member to the snowmobile, but also to provide a force control feature. In this way, adjusting the position of the attaching member closer to or away from the snowmobile can increase or decrease the downward force exerted by the forcing member, and in turn the downward force exerted on the cutting member. Preferably, both the joined and attachable relationships comprise removable type connections whereby conventional rigid nut, bolt and/or washer type connectors join and attach the respective members, for example as seen in the drawings.

The forcing member serves to force the cutting member in a downward direction when the forcing member is attached to the snowmobile. The forcing member may comprise a single integrally formed member or a plurality of members. Preferably the forcing member comprises a plurality of forcing members 44*a–e* when a plurality of cutting members are employed. The forcing member(s) may comprise conventional torsion springs, such a single torsion spring 44*e* or double torsion springs 44*a–d*. Excellent results are presently obtained when each member 44*a–d* comprises a double torsion spring and where the loop of the torsion spring is attached to the snowmobile by respective members 44*a″–e*' and the extending portion 45 of side by side torsion springs is joined to the respective cutting member(s).

Still further, excellent results are obtained when each cutting member is independently forced in the downward direction. For example, this is accomplished through each of the plurality of cutting members being joined to a separate forcing member, or combination of forcing members, where the forcing members are attachable to the snowmobile. Presently, it is preferred that two or more forcing members are attached to a single cutting member, as seen in the drawings. However, it should be understood that a single separate cutting member could be joined and attached to force a cutting member or a group of cutting members, as desired. Further, it should also be understood that an integrally formed forcing member could be constructed to independently force one or more cutting members, all cutting members or select ones of a group of cutting members, as desired.

When the forcing member comprises a plurality of forcing members, a common member 48 preferably communicates with each separate forcing member 44*a–d* and positions each along a horizontal axis. The axis may be a common axis, as shown, or it may be an offset axis. Excellent results are obtained when the common member comprises a hollow tubular shaft that extends through the center coils of the torsion spring(s). Further, preferably the shaft itself is also attached along its length to the snowmobile, such as at point(s) 47, and serves as the primary means for connecting the forcing member(s) to the snowmobile, though indirectly. In this way, the attaching members 44*a″–e″* serve as secondary attaching means and can be better utilized for their force controlling features, as desired.

The forcing member(s) preferably provides a tension force positioning the cutting member(s) in a first forced position 50. The forcing member preferably substantially continuously exerts a downward force on the cutting member(s). Preferably, the downward positioning of the cutting member(s) is limited by a stop member which engages the forcing member, and whereby the first forced position is defined. That is, the stop member could comprise any means for limiting the downward direction of travel of the forcing member and/or cutting member, e.g., a separate attachable structure or an existing snowmobile structure such as a snow flap mounting assembly 15 that is adapted to engage a bottom surface of the extending portion 45 of each forcing member, or an over the top restraining strap or hook, or the like. Additionally, as desired, the cutting member(s) upper limit of vertical motion may be limited by a separate attachable structure or a snowmobile structure such as snowmobile back end structure 13.

The cutting member(s) may be positioned in any range from perpendicular to the snow trail surface to an elevation greater than horizontal to the snow trail surface. Preferably however, the cutting member(s) is positioned at an angle 40 in a range of 30 degrees to 60 degrees relative to the level portion 24 of the snow trail surface. In particular, excellent results are achieved when the angle is 45 degrees. Still further, and depending on the angle 40, preferably the cutting member(s) is sized to extend substantially co-extensive with a horizontal plane defined by the bottom surface of the track of the snowmobile. In this way, the cutting member will substantially skim over the level portion of the snow trail surface and impact at least a portion of any snow mound and/or snow mogul in the snow trail.

Figure 5:
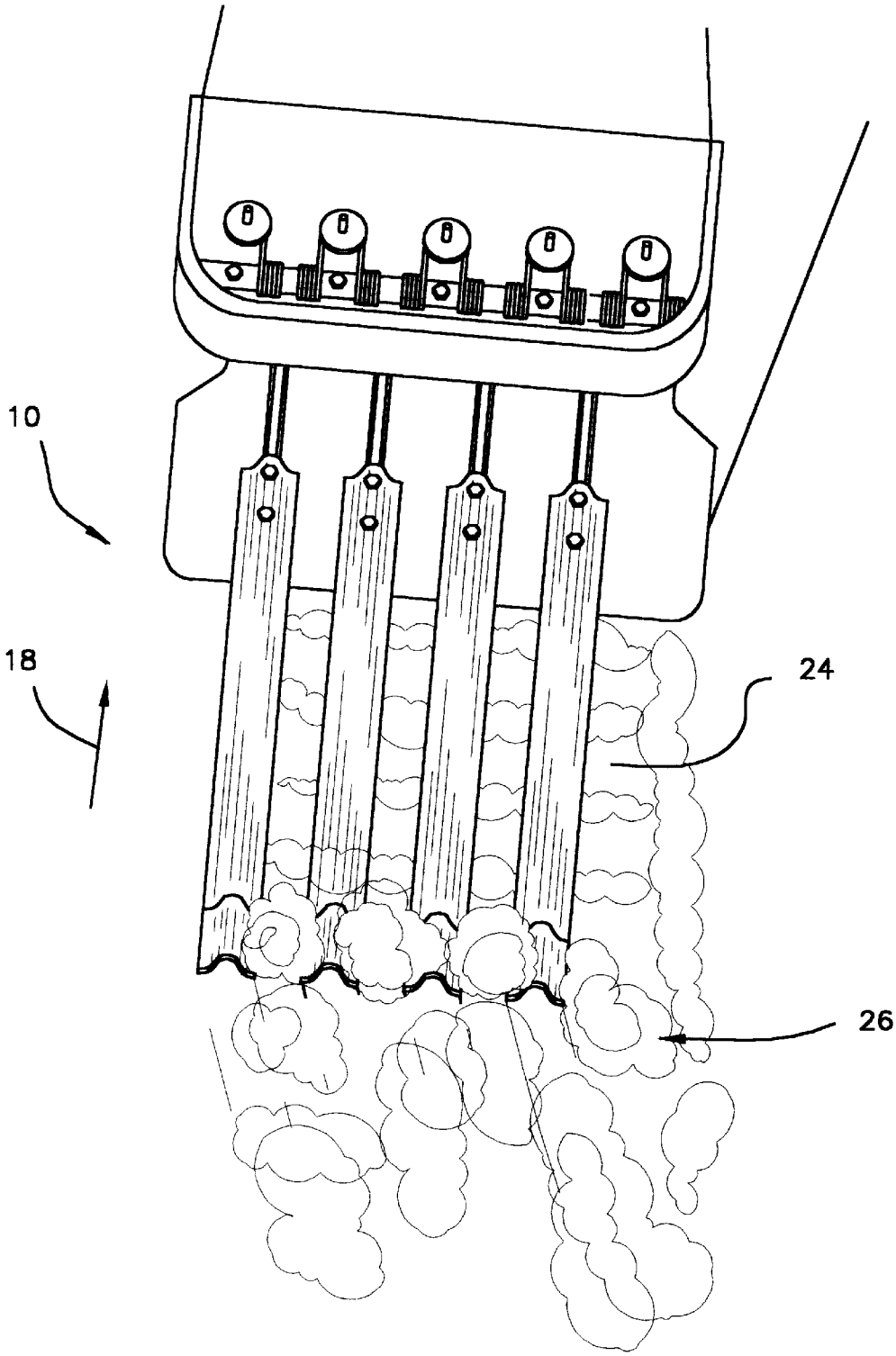
FIG. 5 is a back view of the trail grooming accessory of FIG. 1, here showing the trail grooming accessory moving behind an operating snowmobile and just commencing contact with a snow trail disturbance.
Figure 6:
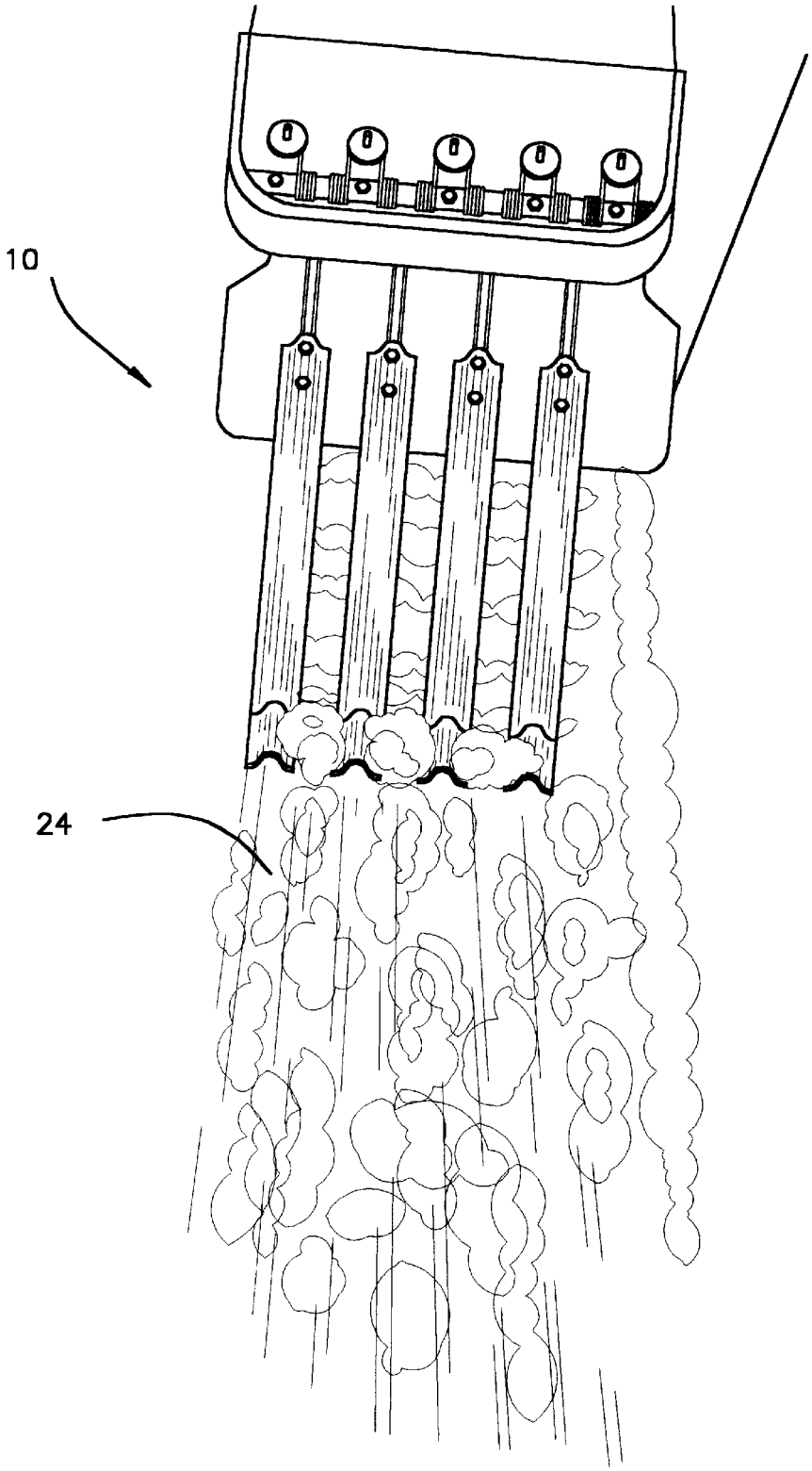
FIG. 6 is another back view of the trail grooming accessory of FIG. 1, here showing the trail grooming accessory moving behind an operating snowmobile and just after it is pulled through a snow trail disturbance.
Figure 7:
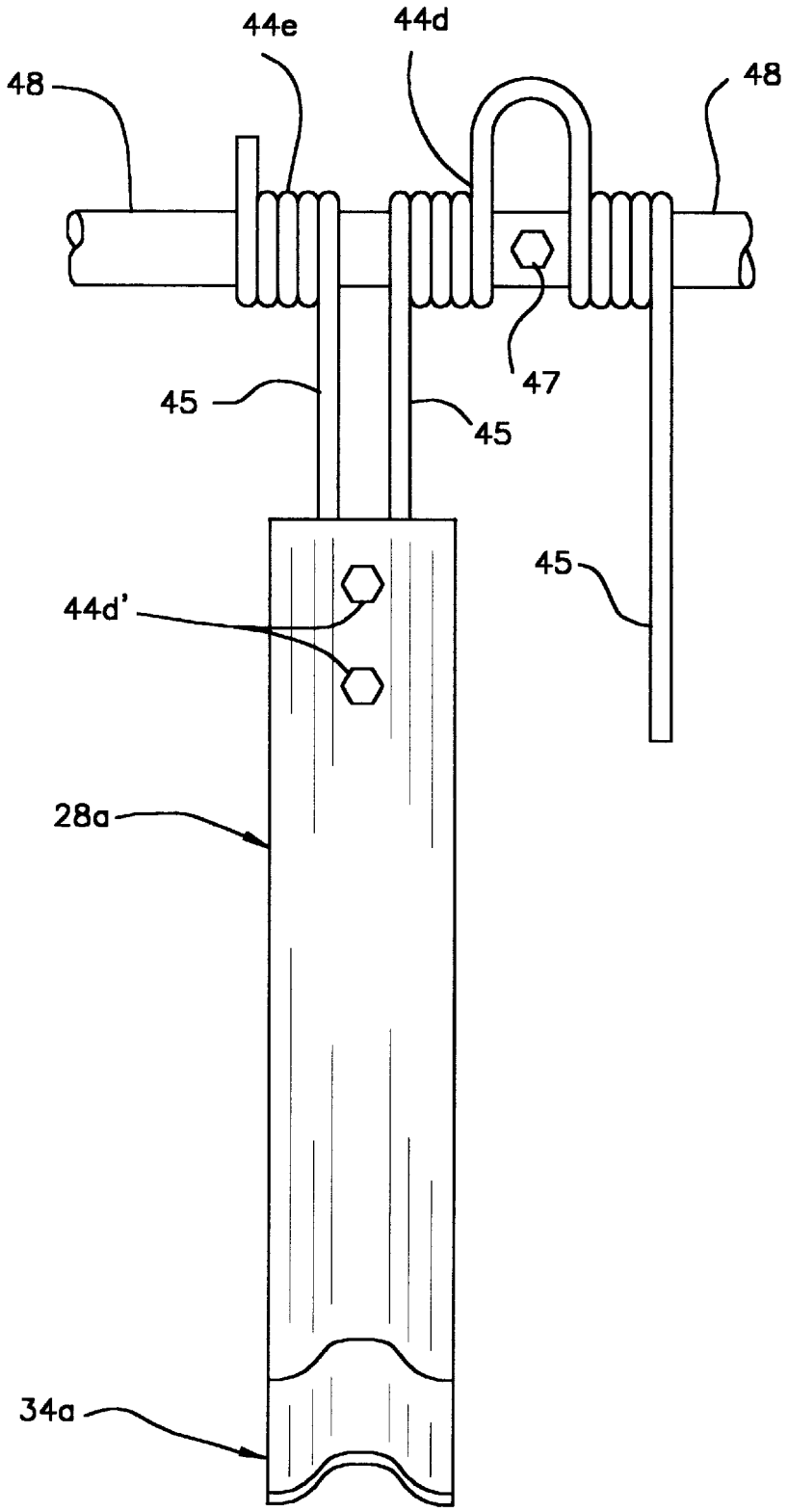
FIG. 7 is a partial elevational view of a trail grooming accessory comprising a cutting member, common member and forcing members, in accordance with the features of the invention, here shown joined together but not attached to a snowmobile.

Referring specifically to FIGS. 5 and 6, for example, another aspect of the invention is directed to a method for grooming the snow trail 22 having a level portion 24 and/or a snow trail disturbance 26, such as a snow mound, a snow mogul or a hazardous snow trail disturbance (not shown). A first step comprises moving the cutting member(s) in the forward direction 18 when the snowmobile is operated, which operation can produce a snow displacement 26. Next, the cutting member(s) is forced in a downward direction. Then, at least a portion of the snow trail is leveled when the at least one cutting member is moving forward.

The step of forcing preferable comprises forcing the cutting member(s) such that the cutting member(s) is maintained in the first forced position 50 and the angled end portion 34 is maintained proximate a common horizontal plane with the bottom surface 14 of the track 16. In this way, during operation the cutting member(s) substantially skims over the level portion of the snow trail surface and will impact at least a portion of any snow mound and/or snow mogul in the snow trail.

Additionally, the step of forcing, and in particular the maintaining step, further comprises substantially continuously maintaining the cutting member(s) in the first forced position to level at least a portion of any snow mound and/or snow mogul in the snow trail. The maintaining step then may include allowing the cutting member(s) to deflect upwards in response to the hazardous snow trail disturbance. Finally, the maintaining step preferably includes returning the cutting member(s) to the first forced position after it passes over the hazardous snow trail disturbance.

As should be obvious, this feature is for safety as well as to enhance the durability and adaptability of the trail grooming accessory to all kinds of snow trail conditions. Also, in this way, the cutting member(s) retains vertical flexibly but otherwise is preferably relatively fixed in the first fixed position. That is, the cutting member(s) preferably does not tend to oscillate or excessively vibrate when moving over the level portion of the snow trail, which usually comprises a majority of the operating time spent on a snow trail.

For analogous reasons as discussed hereinabove, the step of leveling preferably includes displacing forward at least a portion of any snow mound, snow mogul and/or snow displacement, without displacing all of the same. By analogy again, the step of leveling preferably includes deflecting at least a portion of the snow displacement downwardly, without displacing all of the same. Still by analogy again, the method preferably further comprises moving the at least one cutting member in the reverse direction.

As various possible embodiments may be made in the above invention for use for different purposes and as various changes might be made in the embodiments above set forth, it is understood that all of the above matters here set forth or shown in the accompanying drawings are to be interpreted as illustrative and not in a limiting sense.

I claim:

1. A snow trail grooming accessory for use with an operating snowmobile to groom a snow trail surface during operation of the snowmobile, comprising:

a plurality of cutting members, wherein each of the plurality of cutting members is spaced from at least one other of the plurality of cutting members and the plurality of cutting members is adapted to groom the snow trail surface when attached to the operating snowmobile and during operation of the snowmobile; and a forcing member joined to the plurality of cutting members and attachable to the snowmobile, wherein the plurality of cutting members is forced in a downward direction when the forcing member is attached to the snowmobile.

2. The accessory of claim 1, wherein the plurality of cutting members is rigid along its length.

3. The accessory of claim 1, wherein each of the plurality of cutting members is independently forced in the downward direction.

4. The accessory of claim 3, wherein each of the plurality of cutting members has a separate forcing member joined to it and attachable to the snowmobile.

5. The accessory of claim 4, wherein a common member communicates with each separate forcing member and positions each separate forcing member along a horizontal axis.

6. The accessory of claim 1, wherein one or more of the plurality of cutting members has a common forcing member joined to it and attachable to the snowmobile.

7. The accessory of claim 1, wherein the plurality of cutting members includes a longitudinal channel located between flared side portions.

8. The accessory of claim 1, wherein the plurality of cutting members includes an angled end portion.

9. The accessory of claim 8, wherein the angled end portion is positioned in a range of 10 degrees to 90 degrees relative to a level portion of the snow trail surface.

10. The accessory of claim 1, wherein the plurality of cutting members is positioned at an angle in a range of 30 degrees to 60 degrees relative to a level portion of the snow trail surface.

11. The accessory of claim 10, wherein the plurality of cutting members is sized to extend substantially co-extensive with a horizontal plane defined by a bottom surface of a track of the snowmobile.

12. The accessory of claim 10, wherein the angle in the range of 30 to 60 degrees is uniform along an entire length of the plurality of cutting members.

13. The accessory of claim 1, wherein the force in the downward direction is provided by the forcing member connected at an end of the plurality of cutting members where the end is located proximate the operating snowmobile.

14. The accessory of claim 1, wherein the plurality of cutting members is configured to move in a reverse direction without having to manipulate the plurality of cutting members from the downward direction when connected to the operating snowmobile.

15. A method for grooming a snow trail during operation of a snowmobile, the snow trail having a level portion, a snow mound, a snow mogul, a snow displacement from the snowmobile or a hazardous snow trail disturbance, comprising:

moving a plurality of cutting members, the plurality of cutting members being rigid along its length in a forward direction with the snowmobile, the plurality of cutting members being attached to the snowmobile and adapted to groom the snow trail during operation of the snowmobile;

forcing the plurality of cutting members in a downward direction and maintaining the plurality of cutting members in a first forced position wherein an end portion of the plurality of cutting members is maintained proximate a common horizontal plane with a bottom surface of a track of the snowmobile and the end portion substantially skims over the level portion and impacts at least the portion of the snow mound, the snow mogul or the snow displacement in the snow trail; and leveling at least a portion of the snow mound, snow mogul or snow displacement when the plurality of cutting members is moving.

16. The method of claim 15, wherein the step of leveling includes deflecting at least a portion of the snow displacement downwardly.

17. The method of claim 15, further comprising moving the plurality of cutting members in a reverse direction.

18. The method of claim 15, wherein the first forced position is defined by an angle between the plurality of cutting members and the level portion of the snow trail surface and is in a range of 30 degrees to 60 degrees.

19. The method of claim 18, wherein the plurality of cutting members is sized to extend substantially co-extensive with the common horizontal plane.

20. The method of claim 15, wherein the step of maintaining comprises:

substantially continuously maintaining the plurality of cutting members in the first forced position to level at least the portion of the snow mound, the snow mogul or the snow displacement;

allowing the plurality of cutting members to deflect upwards in response to the hazardous snow trail disturbance; and, returning the plurality of cutting members to the first forced position after it passes over the hazardous snow trail disturbance.

21. The method of claim 15, wherein the step of leveling includes displacing forward at least a portion of a member from a group consisting of the snow mound, the snow mogul and the snow displacement.

22. The method of claim 15, wherein the snowmobile is operated in a reverse direction without having to manipulate the plurality of cutting members from the first forced position.

* * * * *

UNITED STATES PATENT AND TRADEMARK OFFICE

CERTIFICATE OF CORRECTION

PATENT NO. : 6,026,600
DATED : February 22, 2000
INVENTOR(S) : Gary J. Lela

It is certified that error appears in the above-identified patent and that said Letters Patent is hereby corrected as shown below:

Column 8,
Line 2, between “length” and “in” insert -- , --.

Signed and Sealed this

Twenty-third Day of July, 2002

*Attest:*

*Attesting Officer*

JAMES E. ROGAN
*Director of the United States Patent and Trademark Office*